US006305539B1

(12) United States Patent
Sanders, Jr.

(10) Patent No.: US 6,305,539 B1
(45) Date of Patent: Oct. 23, 2001

(54) SHIPPING AND STORAGE CONTAINER FOR LAPTOP COMPUTERS

(76) Inventor: C. W. Sanders, Jr., 7261 Euclid Rd., Cincinnati, OH (US) 45243

( * ) Notice: Subject to any disclaimer, the term of this patent is extended or adjusted under 35 U.S.C. 154(b) by 0 days.

(21) Appl. No.: 09/471,066

(22) Filed: Dec. 22, 1999

Related U.S. Application Data

(63) Continuation-in-part of application No. 08/844,558, filed on Apr. 18, 1997, now abandoned.

(51) Int. Cl.[7] ..... B65D 85/00
(52) U.S. Cl. ..... 206/320; 206/523; 206/592
(58) Field of Search ..... 206/701, 320, 206/523, 591, 592, 588; 229/125

(56) References Cited

U.S. PATENT DOCUMENTS 3,192,680 * 7/1965 Mantell et al. ..... 206/320
4,106,597 * 8/1978 Shook et al. ..... 206/523
4,953,705 * 9/1990 Evamy ..... 206/594
5,295,580 * 3/1994 Hicks ..... 206/588
5,494,214 * 2/1996 Fleury et al. ..... 229/149

* cited by examiner

*Primary Examiner*—Paul T. Sewell
*Assistant Examiner*—Shian Luong
(74) *Attorney, Agent, or Firm*—Oldham & Oldham Co., LPA

(57) ABSTRACT

Shipping and storage container for laptop computers which generally includes a one (1) piece exterior portion, preferably fabricated from corrugated cardboard, an inner protective base insert and an inner protective cover insert, both of the protective inserts preferably being fabricated from a material which provides cushioning and protection, most preferably a protective foam type material. The one (1) piece outer container is preferably fabricated from a die cut blank of corrugated cardboard and includes a cover "flap" portion which has a horizontally extending score line located in an intermediate portion of the cover "flap" to allow the cover "flap" to be folded over against itself and retained between the inner protective base insert and the interior back surface of the exterior portion to retain the cover "flap" portion out of the way and allow the shipping and storage container for laptop computers to be used as a base to support the laptop computer positioned therein during test, maintenance and repair procedures.

4 Claims, 4 Drawing Sheets

SHIPPING AND STORAGE CONTAINER FOR LAPTOP COMPUTERS

This application is a Continuation-in-Part of Ser. No. 08/844,558 filed Apr. 18, 1997 now abandoned.

BACKGROUND AND SUMMARY OF THE INVENTION

The present invention relates generally to a new and novel shipping and storage container for laptop computers. More particularly, the present invention relates to a new and novel shipping and storage container for laptop computers which can be used for holding and protecting laptop computers placed therein during shipment and storage and which may be used as a base to support the laptop computers while they are being tested, maintained and/or repaired.

Laptop computers are becoming increasingly popular. While laptop computer are relatively durable, they do contain sensitive components, and protection should generally be provided during shipping, storage and handling. Unfortunately, it is sometimes necessary to send laptop computers to manufacturers or other test, maintenance and repair facilities to have the laptop computers tested, maintained and/or repaired. In the past, shipping and storage containers for laptop computers have generally included a box, most usually fabricated from corrugated, having some type of padding or filler which may, or may not, conform to the configuration of the laptop computer placed therein. Such prior art shipping and storage containers for laptop computers are generally of two (2) types. The first type of shipping and storage container for laptop computers includes a separate cover which is removed and set aside when the container is opened, and thus the exterior portion consists of at least two (2) separate pieces. The second type of shipping and storage container for laptop computers includes an exterior portion which is fabricated from a single integral piece and includes one or more cover "flaps" which fold over the top of the container to form the cover. However, such cover "flaps" tend to get in the way and impede the testing, maintenance and/or repair of the laptop computer when the container is opened. Therefore, when using shipping and storage containers for laptop computers having such cover "flaps," the typical practice is to remove the laptop computer from the container and place it onto a bench or some other work surface to carry out the test, maintenance and/or repair procedures.

Accordingly, an object of the present invention is the provision of a shipping and storage container for laptop computers which is of one (1) piece construction, but which allows the laptop computer positioned therein to be tested, maintained and/or repaired without interference from the cover "flaps" which form the cover of the container.

Another object of the present invention is the provision of a shipping and storage container for laptop computers which cushions and protects the laptop computer positioned therein from damage during shipment and storage and which can also be used as a base to support the laptop computer during testing, maintenance and/or repair procedures.

These and other objects of the present invention are attained by the provision of a shipping and storage container for laptop computers which generally includes a one (1) piece exterior portion, preferably fabricated from corrugated cardboard, an inner protective base insert and an inner protective cover insert, both of the protective inserts preferably being fabricated from a material which provides cushioning and protection and also dissipates static charges, most preferably a foam type material. The one (1) piece exterior portion is preferably fabricated from a die cut blank of corrugated cardboard and includes a cover "flap" which has a horizontally extending score line located in an intermediate portion of the cover "flap" to allow the cover "flap" to be folded over against itself and retained between the inner protective base insert and the interior back surface of the exterior portion to retain the cover "flap" out of the way and allow the shipping and storage container for laptop computers to be used as a base to support the laptop computer positioned therein during test, maintenance and/or repair procedures.

Other advantages and novel features of the present invention will become apparent in the following detailed description of the invention when considered in conjunction with the accompanying drawings.

DETAILED DESCRIPTION OF THE DRAWINGS

Figure 1:
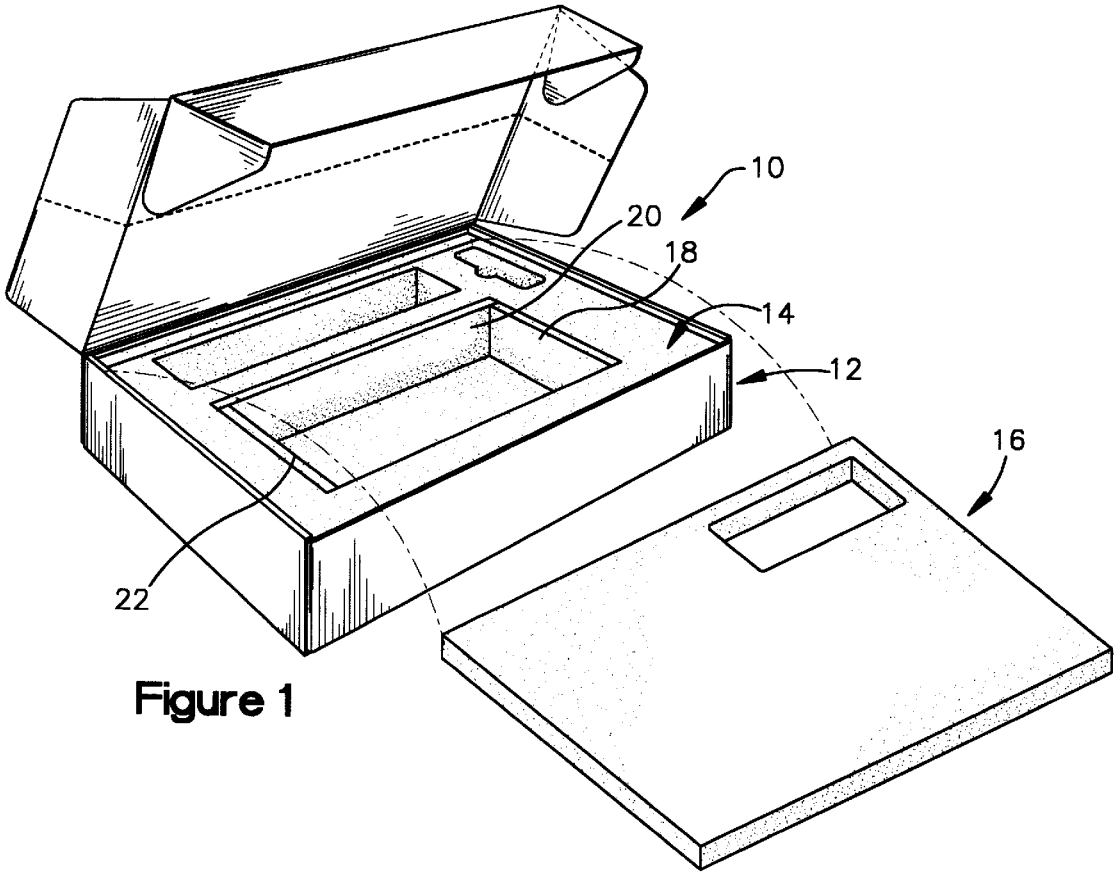
FIG. 1 illustrates a top perspective view of a shipping and storage container for laptop computers in accordance with a preferred embodiment of the present invention.
Figure 6:
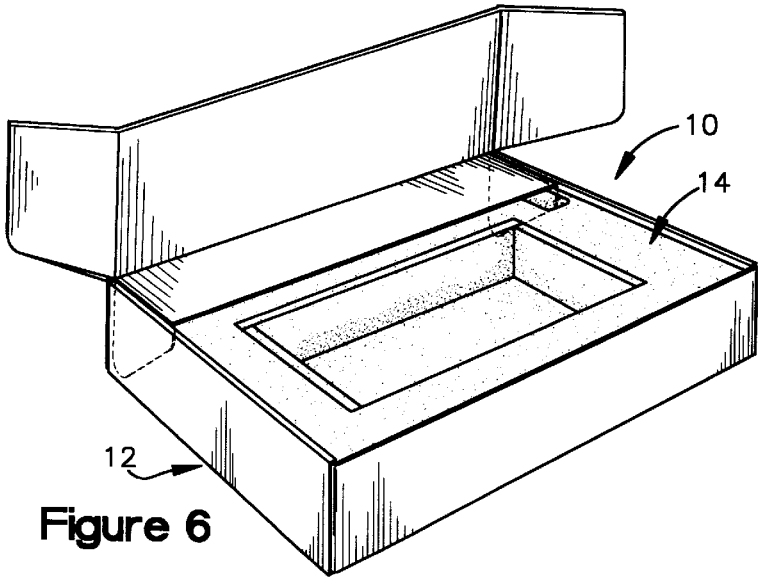
FIG. 6 illustrates a top perspective view of the shipping and storage container for laptop computers in accordance with the preferred embodiment of the present invention shown in FIG. 1 with the cover "flap" portion being folded over upon itself and secured between the external portion of the shipping and storage container for laptop computers and the inner protective base insert such that the shipping or storage container for laptop computers can be used as a base to provide support for the laptop computer positioned therein while it is being tested, maintained and/or repaired.

In the following detailed description of preferred embodiments of the present invention, reference is made to the accompanying drawings which, in conjunction with this detailed description, illustrate and describe a preferred embodiment of a laptop computer shipping and storage container in accordance with the present invention. Referring first to FIG. 1, which illustrates a top perspective view of a shipping and storage container for laptop computers, generally identified by reference number 10, in accordance with a preferred embodiment of the present invention, shipping and storage container for laptop computers 10 generally includes external portion 12, inner protective base insert 14 and inner protective cover insert 16. Shipping and storage container for laptop computers 10 may also include a number of removable inner protective spacers, three (3) of which are shown in FIG. 1, identified by reference numbers 18, 20 and 22, to accommodate and protect laptop computers of different sizes positioned within shipping and storage container for laptop computers 10.

Figure 2:
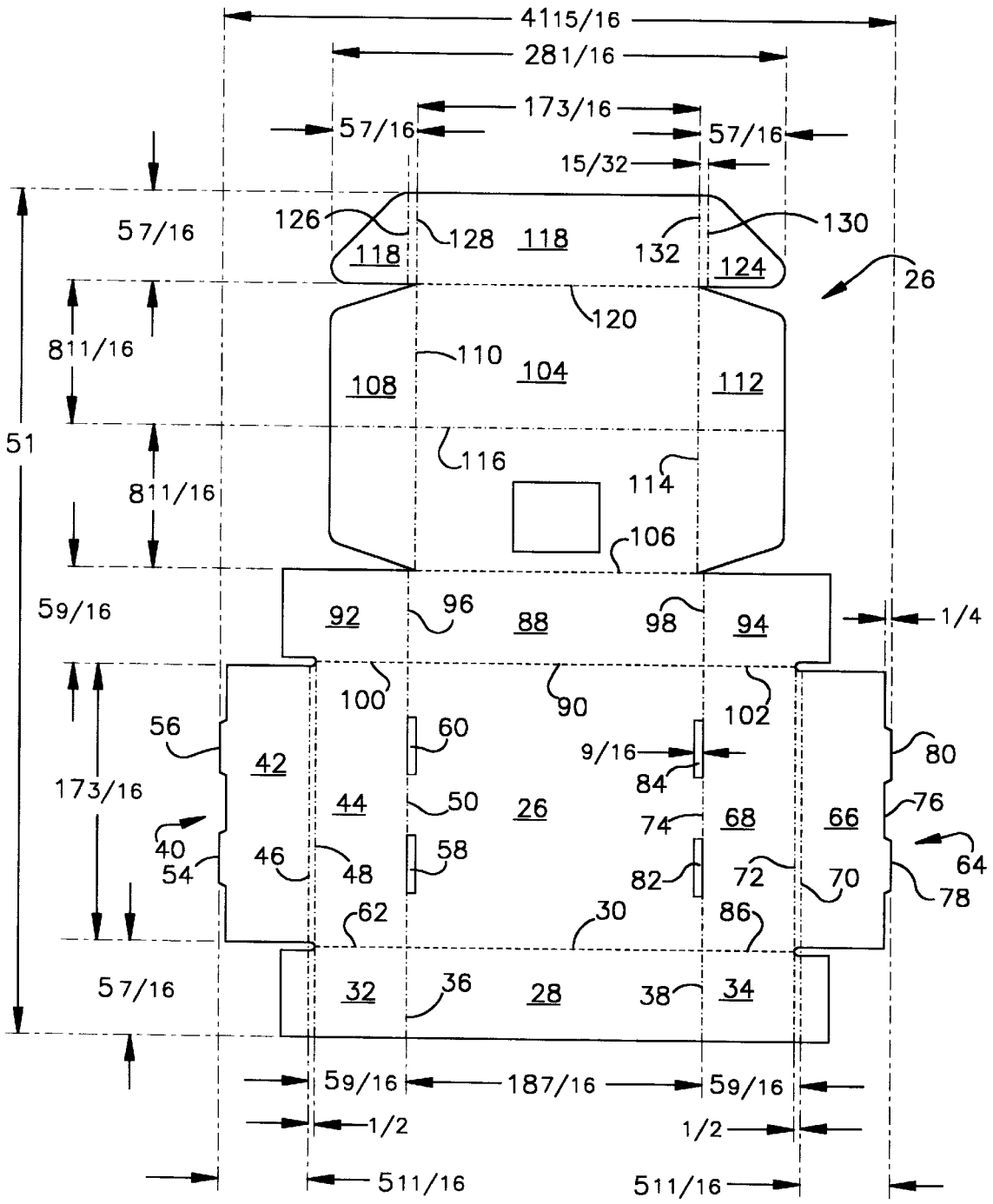
FIG. 2 illustrates a top view of a corrugated cardboard die cut blank which is used to form the external portion of the shipping and storage container for laptop computers in accordance with the preferred embodiment of the present invention shown in FIG. 1.

Referring now to FIG. 2, which illustrates a top view of corrugated cardboard die cut blank 24 which is used to form external portion 12 of shipping and storage container for laptop computers 10 and includes base portion 26, which is generally rectangular in configuration, most preferably being approximately 17 7/16 inches wide and approximately 17 3/16 inches deep. Front flap portion 28 extends forwardly from base portion 26 and score line 30 is located between base portion 26 and front flap portion 28. Front flap portion 28 is preferably approximately the same width as base portion 26 and is approximately 5 7/16 inches high. Left forward flap portion 34 extends from the left side of front flap portion 28 and right forward flap portion 34 extends from the right side of front flap portion 28. Score lines 36 and 38 are located between front flap portion 28 and left forward flap portion 32 and right forward flap portion 34, respectively, and both left forward flap portion 32 and right forward flap portion 34 are approximately the same width as front flap portion 28 and extend outwardly from score lines 36 and 38, respectively, approximately 7 inches.

Left side portion 40 extends outwardly from the left side of base portion 26 and preferably includes interior rectangular portion 42 and exterior rectangular portion 44 separated by score lines 46 and 48, which are preferably positioned approximately ½ inch apart and are approximately equidistant from score line 50 between base portion 26 and interior rectangular portion 42 and distal edge 52 of exterior rectangular portion 44. First outwardly extending projection 54 and second outwardly extending projection 56 extend outwardly from distal edge 52 of interior rectangular portion 42 by approximately ¼ inch and are approximately 2 inches wide. First outwardly extending projection 54 and second outwardly extending projection 56 correspond to first elongated opening 58 and second elongated opening 60, respectively, located in base portion 26 positioned to the inside of, but adjacent to, score line 50. First elongated opening 58 and second elongated opening 60 are approximately 2¼ inches long and approximately 9/16 of an inch wide to accommodate first outwardly extending projection 54 and second outwardly extending projection 56 therein when external portion 12 is assembled. Exterior rectangular portion 44 of left side portion 40 is preferably separated from left forward flap portion 32 by die cut 62 extending through the thickness of corrugated cardboard die cut blank 24.

Right side portion 64 is similar to left side portion 40 in configuration and extends outwardly from the right side of base portion 26 and preferably includes interior rectangular portion 66 and exterior rectangular portion 68 separated by score lines 70 and 72, which are preferably positioned approximately ½ of an inch apart and are approximately equidistant from score line 74 between base portion 26 and interior rectangular portion 66 and distal edge 76 of exterior rectangular portion 68. First outwardly extending projection 78 and second outwardly extending projection 80 extend outwardly from distal edge 76 of interior rectangular portion 66 by approximately ¼ of an inch and are approximately 2 inches wide. First outwardly extending projection 78 and second outwardly extending projection 80 correspond to first elongated opening 82 and second elongated opening 84 located in base portion 26 positioned to the inside of, but adjacent to, score line 74. First elongated opening 82 and second elongated opening 84 are approximately 2¼ inches long and approximately 9/16 of an inch wide to accommodate first outwardly extending projection 78 and second outwardly extending projection 80 therein when external portion 12 is assembled. Exterior rectangular portion 68 of right side portion 64 is preferably separated from right forward flap portion 34 by die cut 86 extending through the thickness of corrugated cardboard die cut blank 24.

Rear flap portion 88 extends rearwardly from base portion 26 and score line 90 is located between base portion 26 and rear flap portion 88. Rear flap portion 88 is preferably approximately the same width as base portion 26 and is approximately 5 7/16 inches high. Left rear flap portion 92 extends from the left side of rear flap portion 88 and right rear flap portion 94 extends from the right side of rear flap portion 88. Score lines 96 and 98 are located between rear flap portion 88 and left rear flap portion 92 and right rear flap portion 94, respectively, and both left rear flap portion 92 and right rear flap portion 94 are approximately the same width as rear flap portion 88 and extend outwardly from score lines 96 and 98, respectively, approximately 7 inches. Left rear flap portion 92 is preferably separated from exterior rectangular portion 44 of left side portion 40 by die cut 100 extending through the thickness of corrugated cardboard die cut blank 24. Similarly, right rear flap portion 94 is preferably separated from exterior rectangular portion 68 of right side portion 64 by die cut 102 extending through the thickness of corrugated cardboard die cut blank 24.

Cover portion 104 extends rearwardly from rear flap portion 88 and score line 106 is located between cover portion 104 and rear flap portion 88. Cover portion 104 is substantially rectangular in configuration and is, most preferably, approximately 17 3/16 inches wide and approximately 17⅜ inches deep. Left side cover flap portion 108 extends from the left side of cover portion 104 and score line 110 is located between cover portion 104 and left side cover flap portion 108. Similarly, right side cover flap portion 112 extends from the right side of cover portion 104 and score line 114 is located between cover portion 104 and right side cover flap portion 112. The outer edges of both left side cover flap portion 108 and right side cover flap portion 112 are preferably tapered inwardly from score line 110 and 114, respectively, to facilitate insertion of left side cover flap portion 108 and right side cover flap portion 112 when exterior portion 12 is assembled. In addition, score line 116 extends horizontally across a central portion of cover portion 104, as well as across a central portion of left side cover flap portion 108 and right side cover flap portion 112. Score line 116 permits cover portion 104, as well as left side cover flap portion 108 and right side cover flap portion 112 to be folded against itself and positioned between inner protective base insert 14 and the interior of external portion 12, when assembled. This allows cover portion 104, as well as left side cover flap portion 108 and right side cover flap portion 112, to be retained out of the way and allows shipping and storage container for laptop computers 10 to be used as a base to support the laptop computer positioned therein during test, maintenance and repair procedures.

Front cover flap portion 118 extends rearwardly from cover portion 104 and score line 120 is located between cover portion 104 and front cover flap portion 118. Front cover flap portion 118 is preferably approximately the same width as cover portion 104 and is approximately 5 7/16 inches high. Left front cover flap portion 122 extends from the left side of front cover flap portion 118 and right front cover flap portion 124 extends from the right side of front cover flap portion 118. Score lines 126 and 128 are located between front cover flap portion 118 and left front cover flap portion 122 and score lines 126 and 128 are positioned approximately 15/32 of an inch apart. Similarly, score lines 130 and 132 are located between front cover flap portion 118 and right front cover flap portion 124 and score lines 130 and 132 are positioned approximately 15/32 of an inch apart. At least one of the outer edges of both left front cover flap portion 122 and right front cover flap portion 124 are preferably tapered inwardly from score lines 126 and 130, respectively, most preferably, the forward edge, to facilitate insertion of left front cover flap portion 122 and right front cover flap portion 124 when exterior portion 12 is assembled.

Figure 4:
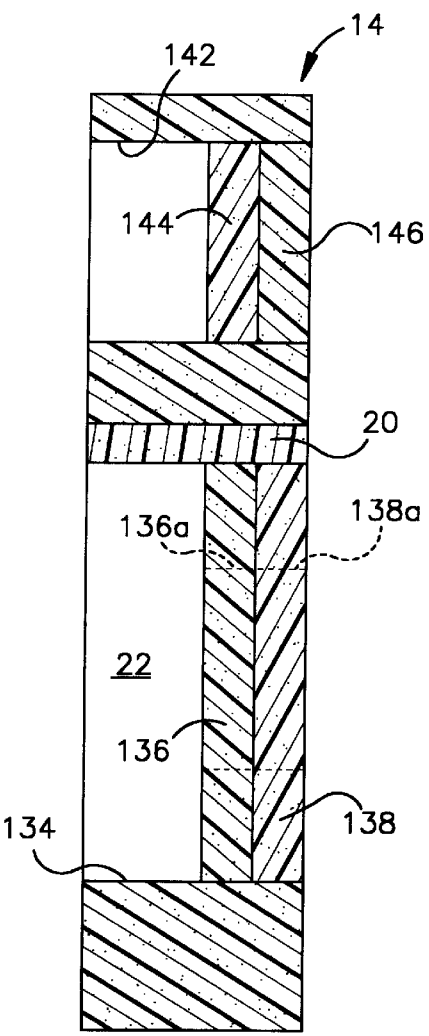
FIG. 4 illustrates a cross-sectional side view of the inner protective base insert which is placed inside the external portion of the shipping and storage container for laptop computers in accordance with the preferred embodiment of the present invention shown in FIG. 1 taken across line 4—4.
Figure 3:
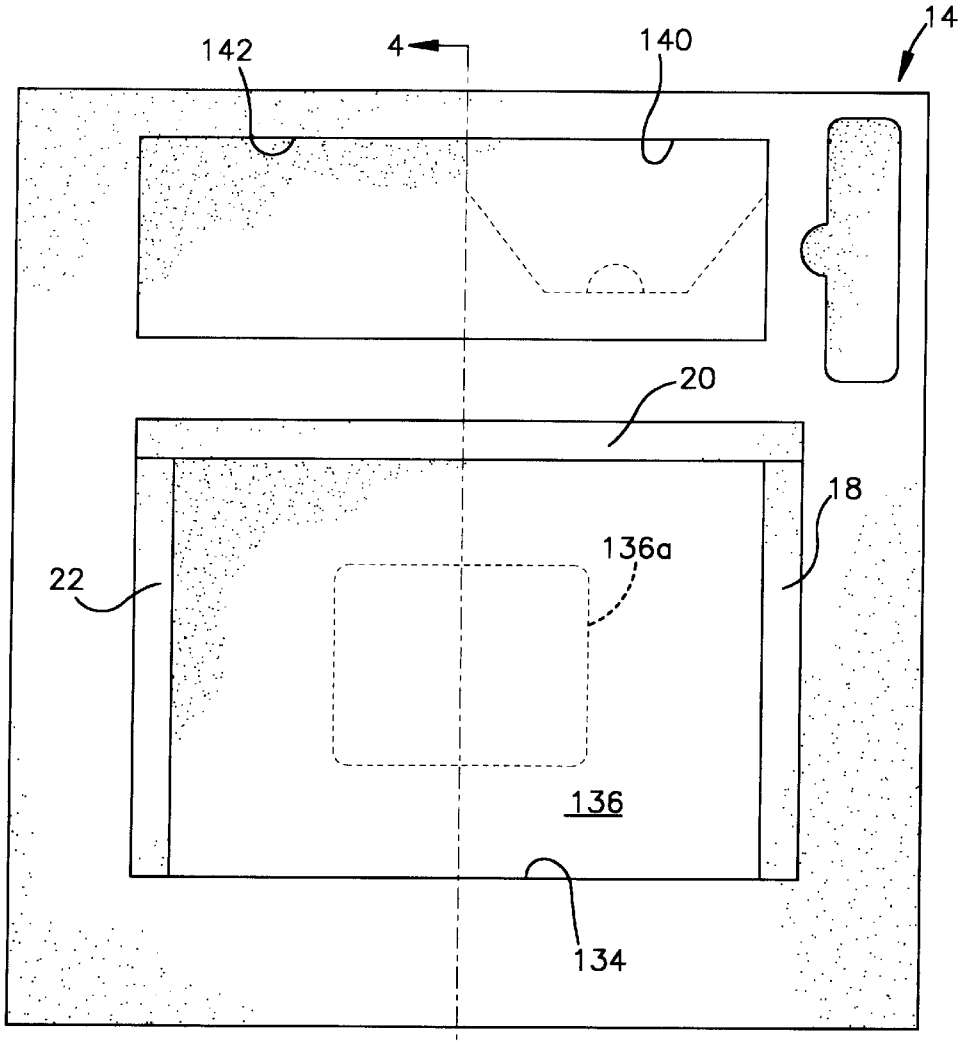
FIG. 3 illustrates a top view of an inner protective base insert which is placed inside the external portion of the shipping and storage container for laptop computers in accordance with the preferred embodiment of the present invention shown in FIG. 1.

Referring now to FIGS. 3 and 4, which illustrate a top view and a cross-sectional side view, respectively, of inner protective base insert 14 which is dimensioned to be placed inside external portion 12 when assembled. Inner protective base insert 14 is substantially rectangular in configuration and is preferably fabricated from a cushioning protective material which is further capable of dissipating static charge, such as a foam type material. Inner protective base insert 14 includes a substantially rectangular cut-out 134 which is preferably approximately centrally positioned in inner protective base insert 14. Substantially rectangular cut-out 134 accommodates and provides protection for a laptop computer positioned therein. Substantially rectangular cut-out 134 is preferably cut through the entire width of inner protective base insert 14. However, substantially rectangular cut-out 134 could also be cut partially through the thickness of inner protective base insert 14, if desired. One or more rectangular protective pieces, two (2) of which are shown in FIG. 4, identified by reference numbers 136 and 138, are preferably inserted into substantially rectangular cut-out 134 to provide protection for the bottom surface of the laptop computer positioned therein. Additional cut-outs, two (2) of which are shown in FIG. 3, identified by reference numbers 140 and 142, may be provided, as desired, to hold and protect items such as connectors, adapters and peripheral devices used in conjunction with the laptop computer positioned therein. Additional rectangular protective pieces, two (2) of which are shown in FIG. 4, identified by reference numbers 144 and 146, are provided for additional cut-outs 140 and 142. Rectangular protective pieces 136, 138, 144 and 146 are preferably fabricated from a cushioning and protective material, which also dissipates static electricity, such as a foam type material.

Figure 5:
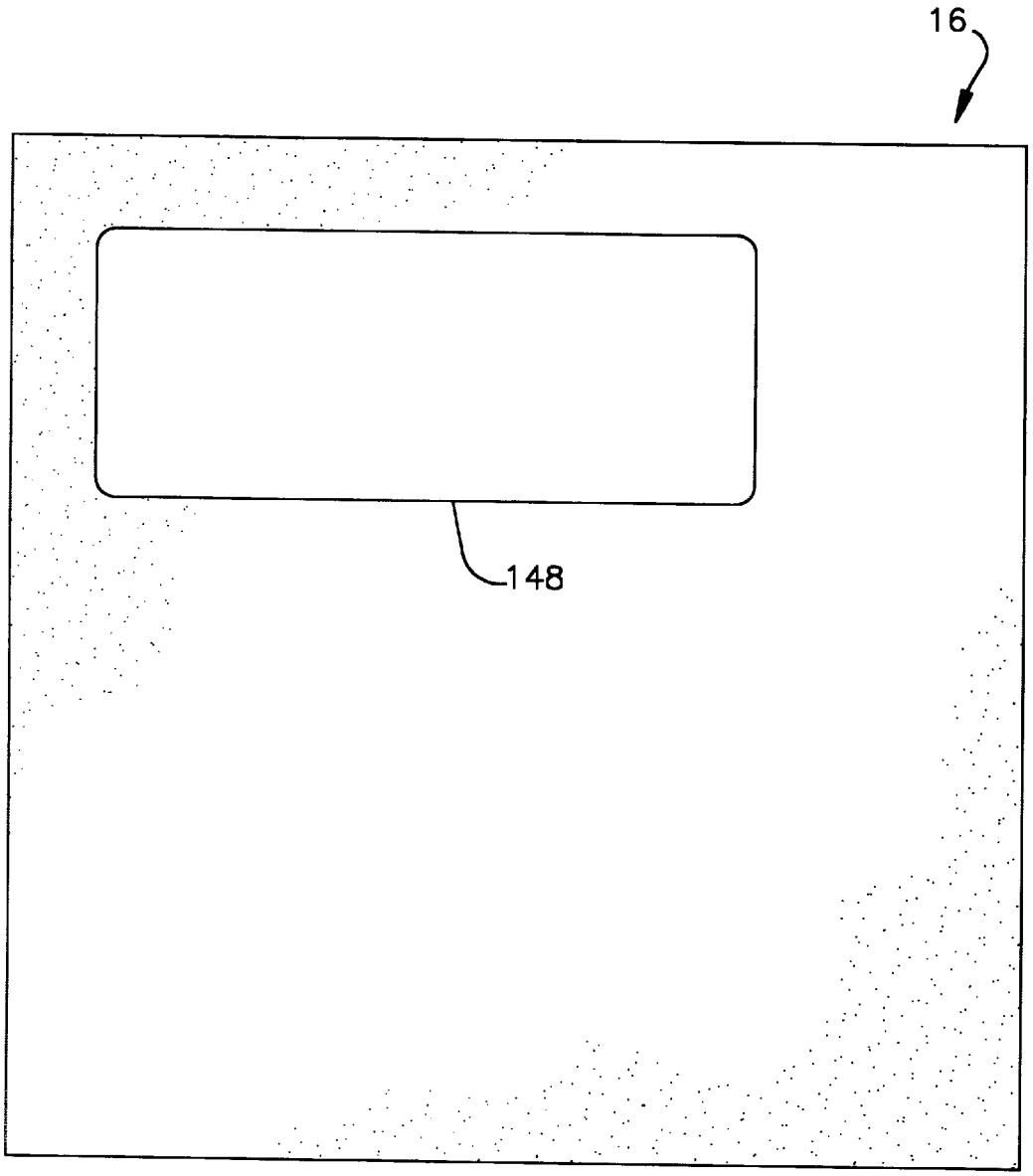
FIG. 5 illustrates a top view of an inner protective cover insert which is placed inside the external portion of the shipping and storage container for laptop computers on top of the inner protective base insert and the laptop computer positioned therein in accordance with the preferred embodiment of the present invention shown in FIG. 1.

Referring now to FIG. 5, which illustrates a top view of inner protective cover insert 16 which is placed inside external portion 12 on top of inner protective base insert 14 and the laptop computer positioned therein. If desired, inner protective cover insert 16 can include one or more cut-outs, one of which is shown in FIG. 5, identified by reference number 148, which can be removed, if desired, to provide clearance for the laptop computer positioned within shipping and storage container for laptop computers.

To assemble shipping and storage container for laptop computers 10, corrugated cardboard die cut blank 24 is first assembled into external portion 12 by folding front flap portion 28 upwardly along score line 30, folding left forward flap portion 32 upwardly along score line 36 and folding right forward flap portion 34 upwardly along score line 38 such that front flap portion 28 is positioned upwardly with left forward flap portion 32 located along score line 50 and right forward flap portion 34 located along score line 74. Rear flap portion 88 is then folded upwardly along score line 90, left rear flap portion 92 is folded upwardly along score line 96 and right rear flap portion 94 is folded upwardly along score line 98 such that rear flap portion 88 is positioned upwardly with left rear flap portion 92 located along score line 50 and right rear flap portion 94 located along score line 74. Left side portion 40 is then folded inwardly along score lines 46, 48 and 50 so interior rectangular portion 42 is positioned inwardly of exterior rectangular portion 44 over left forward flap portion 32 and left rear flap portion 92 and first and second outwardly extending projections 54 and 56 are inserted into first and second elongated openings 58 and 60, respectively.

Right side portion 64 is then folded inwardly along score lines 70, 72 and 74 so interior rectangular portion 66 is positioned inwardly of exterior rectangular portion 68 over right forward flap portion 34 and right rear flap portion 94 and first and second outwardly extending projections 78 and 80 are inserted into first and second elongated openings 82 and 84, respectively.

Inner protective base insert 14 is then positioned on base portion 26 and one or more rectangular protective pieces 136 and 138 are positioned in substantially rectangular cut-out 134. One or more removable inner protective spacers 18, 20 and 22 are then positioned, as needed, within substantially rectangular cut-out 134 and shipping and storage container for laptop computers 10 is ready for placement of a laptop computer therein. Other components, such as connectors, adapters and peripheral devices are placed in the remaining cut-outs 140 and 142, if desired, and inner protective cover insert 16 is placed over inner protective base insert 14.

Left side cover flap portion 108 is then folded downwardly along score line 110 and right side cover flap portion 112 is folded downwardly along score line 114. Cover portion 104 is then folded over the top of inner protective cover insert 16 along score line 106. Front cover flap portion 118 is then folded downwardly along score line 120 and left front cover flap portion 122 is folded along score lines 126 and 128 and left front cover flap portion 122 is inserted into the opening between exterior rectangular portion 44 and left forward flap portion 32. Similarly, right front cover flap portion 124 is folded along score lines 130 and 132 and right front cover flap portion 124 is inserted into the opening between exterior rectangular portion 68 and right forward flap portion 34. At this time, shipping and storage container for laptop computers 10 is ready for shipment and/or storage and, if desired, a mailing label and/or some product identification information could be placed on the exterior surface of cover portion 104.

When received, shipping and storage container for laptop computers 10 is opened by removing left front cover flap portion 122 from the opening between exterior rectangular portion 44 and left forward flap portion 32 and removing right front cover flap portion 124 from the opening between exterior rectangular portion 68 and right forward flap portion 34. Cover portion 104 is then opened along score line 106 and inner protective cover insert 16 is removed to gain access to the laptop computer or electronic device positioned therein. If desired, cover portion, left side cover flap portion 108 and right side cover flap portion 112 can be folded along score line 116 and front cover flap portion 118, left front cover flap portion 122 and right front cover flap portion 124 positioned between the interior of rear flap portion 88 and inner protective base insert 14 to hold cover portion 104 out of the way and allow shipping and storage container for laptop computers 10 to be used as a base to support the laptop computer positioned therein during test, maintenance and repair procedures. In addition, if desired, shipping and storage container for laptop computers 10 could be stacked with cover portion 104 retained out of the way as described above so shipping and storage container for laptop computers 10 would be open and ready for placement of a laptop computer therein.

In certain situations it has been found desirable to form a rectangular shaped hole in one or both of the rectangular protective pieces 136 and 138 as best seen in FIGS. 3 and 4 of the drawings. This is now indicated by numeral 136*a* in FIG. 3 and FIG. 4 showing the approximate shape and position of these cut-outs. Cut-out in rectangular protective piece 138 is shown by dotted line 138*a* in FIG. 4. Essentially, the cut-outs 136*a* and 138*a* would be approximately four (4) inches by six (6) inches in size and are preferably approximately centrally positioned on respective rectangular protective pieces 136 and 138 as indicated by dotted line 136*a* in FIG. 3.

It has been found that a better cushioning of the laptop computer positioned in substantially rectangular cut-out 134 occurs with this cut-out because it tends to absorb the weight of the laptop computer in a better suspended relationship upon drop and/or jarring motions much in the same way that a donut is used to cushion a sore part of the human body, for example, the circular cushion used for corns or sore portions of feet or toes.

It should be understood that one of the primary utilitarian functions of the design shown in FIGS. 1 through 6 for shipping and storage container for laptop computers 10 is the protection of the laptop computer from jarring and dropping and any rough handling which normally occurs to a container as it sent by mail or truck or airplane in the normal course of its shipping and handling. To this end, thus, it is desirable to maintain the basic ratios of size and thickness of inner protective base insert 14, inner protective cover insert 16 and rectangular protective pieces 136 and 138 and the basic dimensional relationships shown in the drawings. There are certain standard drop specifications that are important to manufacturers of the laptop computers in order to properly protect the laptop computers during normal and routine handling in shipping of these products.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A shipping and storage container for laptop computers or electronic devices, comprising:

an exterior portion fabricated from a one piece corrugated cardboard die cut blank, so as to form an open top box configuration having four upstanding walls of equal heights such that the height is at least twice the height of the laptop computer;

an integral cover portion attached to a top edge of one of said upstanding walls and including a first score line at the attachment to permit the cover portion to fold over the open top box configuration to close the opening;

a protective base insert made from a foam type cushioning material in a close tight fitting frictional relationship within the box configuration wherein such insert has a portion removed to receive the laptop computer into a tight fitting frictional relationship within the insert to cushion the laptop computer on all sides except the bottom and top;

a protective top insert made from a foam type cushioning material positioned in a tight fitting frictional relationship within the box configuration on top of the laptop computer wherein said cover portion has flaps extending therefrom to frictional engage the box configuration to hold the cover portion in closed relationship to the box configuration, and wherein the inner protective base insert bottom portion incorporates a centrally positioned void having an open dimension of at least ¼ the length and width of the computer and at least one-half the thickness of the bottom portion of the protective base insert whereby the laptop computer positioned in the container will be supported by the base insert bottom only around that portion of its outer periphery on the bottom side thereof laterally outside the void.

2. A shipping and storage container for laptop computers in accordance with claim 1, wherein the protective base insert is at least 3⅞ inches thick and provides an indent load deflection between 40 and 70, and the protective top insert is at least 1 inch thick and provides an indent load deflection between 40 and 70.

3. The shipping and storage container for laptop computers in accordance with claim 1, wherein said inner protective base insert has a width of at least 3 inches laterally around the removed portion so as to provide at least a 3 inch cushion of foam type cushioning material around the lateral edges of the laptop computer positioned therein and further wherein the thickness of the protective base insert on the bottom is greater than the thickness of the protective top insert.

4. The shipping and storage container for laptop computers in accordance with claim 1, wherein said the protective base insert incorporates removable pieces around at least a portion of the periphery of the portion removed which are at least ½ inch in thickness, and removable to allow adjustment of the size of the portion removed so as to accommodate the rectangular peripheral configuration of the laptop computer to achieve a tight fitting frictional relationship within the insert.

* * * * *